United States Patent [19]

Kapp

[11] 3,937,444

[45] Feb. 10, 1976

[54] MIXER

[75] Inventor: Arno Fritz Ottomar Kapp, Retford, England

[73] Assignee: Jenkins of Retford, Ltd., Retford, England

[22] Filed: June 17, 1974

[21] Appl. No.: 480,270

[30] Foreign Application Priority Data

June 19, 1973 United Kingdom ..... 29115/73

[52] U.S. Cl. ..... 259/40

[51] Int. Cl.[2] ..... B01F 7/00

[58] Field of Search ..... 259/40, 37, 102, 99, 64, 259/5, 19, 21, 118, DIG. 1, DIG. 10

[56] References Cited

UNITED STATES PATENTS 3,338,562 8/1967 Fox ..... 259/40

3,602,486 8/1971 Nauta ..... 259/102

*Primary Examiner*—Robert W. Jenkins

*Attorney, Agent, or Firm*—Kurt Kelman

[57] ABSTRACT

The invention concerns mixers having a mixing screw moved within a mixing receptacle both about the axis of rotation of the screw and also along a generally epicyclic path within the mixing receptacle, all movements of the screw being imparted from a single power location which permits for the provision of a satisfactory outlet location for material from the receptacle.

5 Claims, 2 Drawing Figures

MIXER

Figure 1:
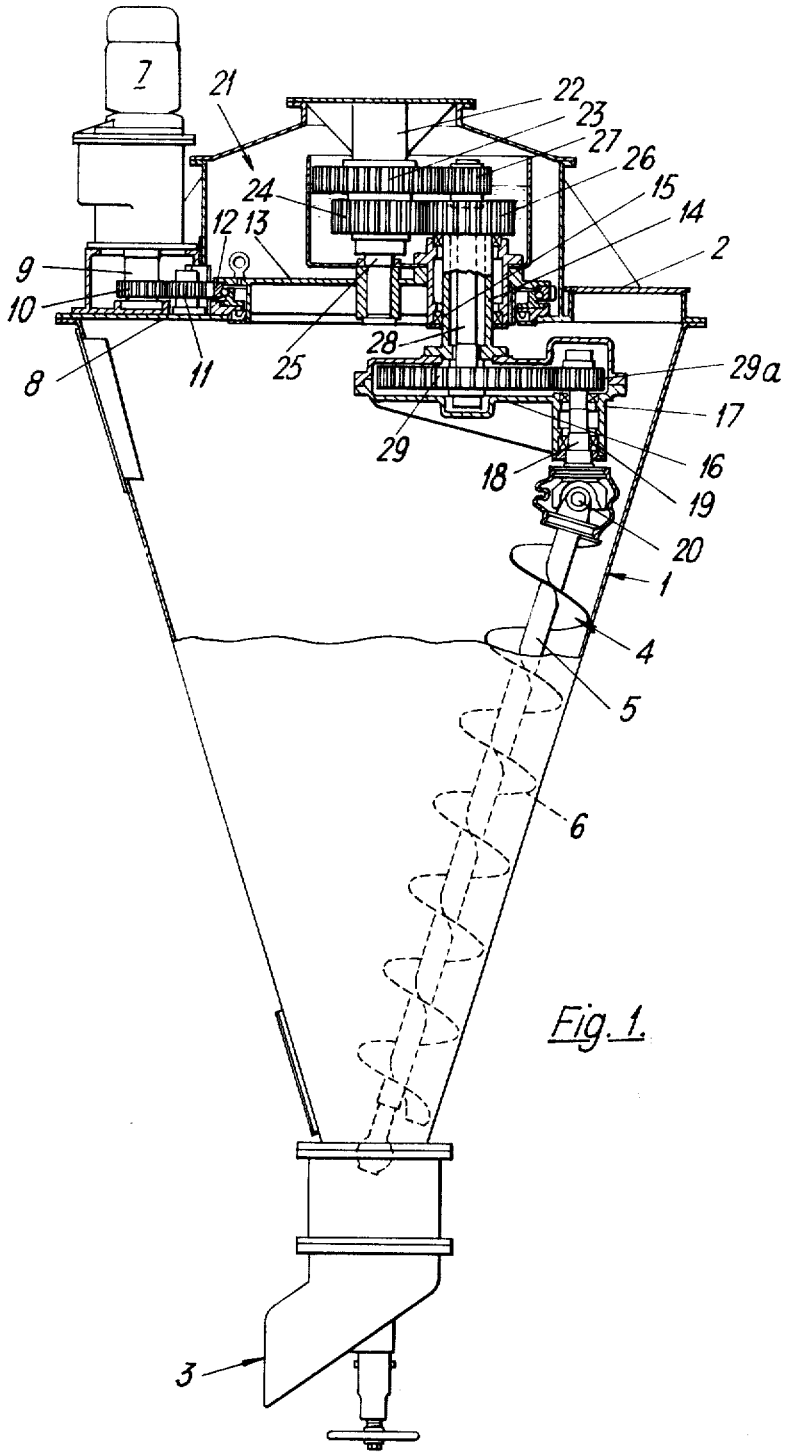

This invention relates to a mixer and more particularly to a mixer capable of accomplishing thorough and rapid mixing of mixture ingredients, liquid and/or solid, fed thereto.

U.S. Pat. No. 3,338,562. describes a mixer which comprises a receptacle of inverted hollow conical form with an axis of symmetry and having an outlet towards the lower apex thereof A conveying screw is rotatable about its own axis to move material within the receptacle and, in operation of the device, is moved to follow a path, within the receptacle, with a motion including both rotational and radial components with respect to the axis of symmetry of the receptacle.

In the prior proposed mixer, two driving motors are provided, one driving motor serving to rotate the conveying screw about its own axis, the other driving motor being adapted to drive a driving arm and a screw arm to constrain the screw to follow a path within the receptacle with a motion including both rotational and radial components with respect to the axis of symmetry of the receptacle.

In the prior proposed mixer, the material mixed within the receptacle is removed therefrom through an outlet provided with a closable door and located in one side wall of the container adjacent the lower apex thereof, the outlet being provided with a chute or spout.

The prior proposed mixer thus suffers from the disadvantage that two motors need be provided. Similarly the prior proposed mixer suffers from the disadvantage that, on opening the closable door provided at the outlet, most but not all the material within the mixer will pass from the mixer, and a portion of the material in the mixer will remain in the mixer, thus contaminating any further different material introduced to the mixer.

Such prior proposal, because the axial rotation of the screw was effected from the base of the screw, was provided with a universal coupling at the base of the receptacle and such coupling, because of its location wholly within the material, often become damaged or seriously worn rapidly where abrasive ingredients were being mixed.

It is an object of the present invention to provide an improved mixer in which at least one of the former disadvantages is obviated or reduced.

According to this invention, there is provided a mixer comprising at least one mixing receptacle having an axis of symmetry and having at least one conveying screw rotatable about its own axis and rotatable epicyclically, said mixer comprising a motor adapted to drive a first rotary member about an axis of rotation, a second rotary member being mounted for rotation with an axis of rotation radially spaced from the axis of rotation of the first rotary member, the second rotary member supporting one end of said conveying screw at a point radially spaced from the axis of rotation of the second rotary member, means being provided for rotationally driving said second rotary member, and said conveying screw from said motor.

According to one feature of this invention the receptacle of the mixer may be provided with a conical or part conical receptacle, the apex of the cone locating a universal joint for the lower end of the screw and a ring valve extending at least partially around said universal joint, said ring valve being located at, or close to, the lowermost point of said receptacle.

Figure 2:
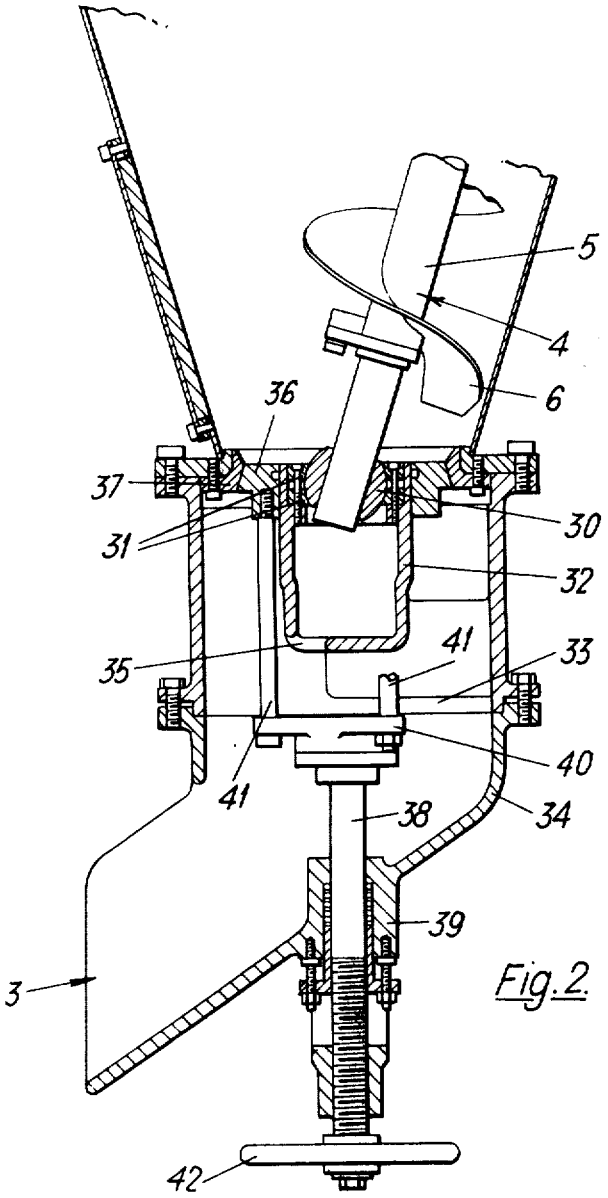

In order that the invention may be more readily understood, and so that further features thereof may be more readily appreciated, a mixer in accordance with this invention will now be described by way of example and with reference to the accompanying drawings in which:

FIG. 1 is a part sectioned vertical medial sectional view through the mixer in accordance with this invention; and FIG. 2 is an enlarged fragmentary vertical medial sectional view through the lower outlet end portion of the mixer of FIG. 1.

In this embodiment, the mixer comprises an inverted hollow conical mixing receptacle 1 provided with an inlet 2 at the upper end thereof and an outlet 3 at the lower apex thereof. Mounted within the receptacle is a conveying screw 4 comprising a central main shaft 5 having secured thereto a spiral flange 6. The conveying screw 4 is secured at the base of the receptacle and is driven rotationally about its own axis and epicyclically by means of an electric motor 7 provided on the upper portion of the receptacle.

This motor 7 is mounted substantially vertically adjacent and above the side wall of the receptacle 1 on an upper cover 8 of the receptacle 1. The cover 8 in this instance is sealed and is secured to the receptacle 1 to enable the receptacle to be pressurised. Gearing, to be described hereinafter, for driving the mixing screw is mounted on the upper cover.

Mounted on a driving shaft 9 of the motor is a gear wheel 10 adapted to rotate an intermediate gear wheel 11 which is mounted for rotation on ball bearings. This intermediate gear wheel 11 engages an externally toothed slewing ring 12 which is mounted on ball bearings secured to the upper cover of the receptacle, the slewing ring 12 being secured to a first rotary member 13 which is adapted and positioned to rotate substantially about the axis of symmetry of the receptacle, i.e. the central vertical axis of the conical receptacle 1. This first rotary member 13 is generally circular and has mounted thereon at a position radially spaced from the axis of rotation thereof a downwardly depending hollow support member 14 which is rotatably mounted on the first rotary member 13 by means of roller bearings 15. The downwardly depending support member 14 has rigidly secured thereto a horizontally extending second rotary member 16 which is adapted to rotate about the axis of the downwardly depending support member 14. The second rotary member carries, at a position radially spaced from the axis of rotation thereof, a second hollow downwardly depending support member 17 which has a first vertical rotatable support shaft 18 mounted rotatably therein by roller bearing 19. This first vertical rotatable shaft 18 is secured by means of a universal joint 20 to the upper end of the mixing screw shaft 5. Mounted on the upper cover 8 of the receptacle 1 is a housing 21 having a downwardly depending hollow stem 22 which carries two radially extending tooth gear wheels 23, 24, mounted one above the other. The first rotary member 13 is supported by a bearing 25 that extends into hollow stem 22.

The gear wheel 24 is adapted to engage with a first planetary gear 26 which is rigidly secured to downwardly depending hollow support member 14. The upper gear wheel 23 (which is of larger diameter) engages with a planetary gear 27 which is secured to a second vertical rotary support shaft 28 which is rotatably mounted within hollow support member 14 and which is adapted to rotate a further drive gear 29 mounted within the second rotary member 16. This gear 29 engages with yet another gear 29*a* provided at the top of the first vertical support shaft 18 connected to the universal joint 20 of the upper end of the drive screw 1.

The lower end of the drive screw shaft 5 is mounted in a universal joint having a centering ball 30 mounted within a plurality of sealing rings 31, this ball 30 being bored diametrically, in which bore the shaft 5 rides.

In operation of the mixer, when the electric motor 7 is activated, drive shaft 9 rotates the gear wheel 10 which rotates the intermediate gear wheel 11 which in turn rotates the slewing ring 12 of the first rotary member 13. As the member 13 rotates, the first downwardly depending support member 14 is driven around the axis of rotation of the first rotary member 13 and the first planetary gear 26, which is for epicyclic screw movement, engages with the lower fixed gear 24 and thus the first downwardly depending support member rotates 14 with respect to the first rotary member 13, thus rotating the horizontally extending second rotary member 16.

Similarly, as the first rotary member 13 rotates the second planetary gear 27, which is for the mixing screw drive, engages with the upper fixed gear 23 and the second vertical shaft 28 passing through the first downwardly depending support member 14 rotates, thus rotating the further drive gear 29 which in turn rotates the gear 30 and the vertical shaft 18 connected to the upper end of the conveying screw shaft 5. Thus the conveying screw 1 is rotated about its own axis and by rotation of the second rotary member traces out a circular path with respect to the first rotary member 13. However, as the first rotary member 13 is itself rotating, the actual path of the mixing screw is a generally epicyclic path.

In utilising this embodiment of the invention, only one motor is utilised for driving the conveying screw both in rotation about its own axis and through an epicyclic path.

As described hereinbefore, the lower end of the conveying screw shaft 5 is mounted in a universal joint. This universal joint is supported by a cylindrical hollow housing 32, the centering ball 30 being supported by the interior of the periphery of the open upper end of hollow housing 32, the hollow housing being supported by a solid web 33 which is secured to one side wall of an outlet chute 34. The hollow housing 32 is provided with an aperture 35 communicating with the outlet chute 34, which is located immediately under the receptacle of the conical mixer.

The seal between the receptacle 1 and the outlet 34 is provided by a ring valve which comprises a valve member 36 which surrounds the hollow housing 32 and which is provided with a seal on the inner periphery thereof which engages with the outer surface of the hollow housing. The outer peripheral surface of the valve member is chamfered. A valve seat 37 in the form of an annular member is secured to the base of the receptacle 1 of the mixer, the inner periphery of the annular member being chamfered to engage with the valve member 36 of the ring valve.

The ring valve member 36 is moved towards and away from the seat 37 in a vertical direction by means of an externally threaded drive shaft 38 which passes through an internally threaded boss 39 on one wall of the chute 34 and which is provided with a seal to ensure that any substances passing from the receptacle are retained within the chute and do not pass along the shaft 38. The drive shaft 38 is secured to a drive disc 40, and three rods 41 connect the drive disc to the valve member 36. The drive shaft 38 is provided with a drive wheel 42 to enable the ring valve to be manually moved from an open position to a closed position and vice versa.

In operation of the device, the ring valve is first moved to a closed position and the mixing receptacle is filled with material to be mixed. The conveying screw is then rotated to mix the material as hereinbefore described and subsequently the ring valve is lowered to open valve thus enabling mixture contained within the receptacle 1 to pass through the opened valve in the base of the mixer, past the housing 32 containing the lower universal joint and through the outlet chute 34 to outlet 3. It should be noted that the hole 35 in the housing 32 supporting the universal joint communicates with the outlet chute so that, should any material contained within the mixer pass the centering ball 30 and the seals of the lower universal joint, this material will pass through the hole communicating with the outlet chute and will pass through the outlet chute when the material contained within the mixing receptacle is discharged therefrom. Subsequent to the material being discharged from the mixing receptacle, the ring valve would again be moved to a closed position. It is envisaged that, if the conveying screw is rotated in an appropriate direction, material contained within the receptacle may be encouraged to flow out through the outlet chute.

The ring valve is located at the lowermost point of the receptacle, thus enabling the receptacle to be completely emptied easily.

I claim:

1. In combination with a mixer comprising a mixing receptacle having an axis of symmetry, a top at one end of the axis and an outlet end at an end of the axis opposite to the one end; a conveying screw in the receptacle, the conveying screw being rotatable about its axis and epicyclically, and having an end adjacent the one end of the axis and an opposite end adjacent the opposite axis end for conveying mixed material to the outlet end of the receptacle; and a universal joint coupling the opposite end of the conveying screw to the outlet end of the receptacle; a drive for the conveying screw mounted at the top of the receptacle, the drive including 1. a motor,
2. a first rotary member arranged to be driven by the motor about an axis of rotation,
3. a second rotary member mounted for rotation with an axis of rotation radially spaced from the axis of rotation of the first rotary member,
   a. the second rotary member supporting and rotating the end of the conveying screw adjacent the one axis end at a point radially spaced from the axis of rotation of the second rotary member; and
4. means coupling the second rotary member to the motor to be driven thereby, rotation of the first and second rotary members by the motor causing the conveying screw to be rotated about its axis and epicyclically.

2. In the combination of claim 1, the mixing receptacle being conical and narrowing from the top to the outlet end.

3. In the combination of claim 1, the outlet end of the mixing receptacle defining an outlet opening coaxial with the axis of symmetry, and further comprising a ring valve mounted in the opening, and means for operating the ring valve to assume an open and closed position.

4. In the combination of claim 3, further comprising a mounting for the universal joint in the outlet opening, the ring valve being comprised of an annular valve member mounted on and sealingly surrounding the mounting, and an annular valve seat mounted on the outlet end of the mixing receptacle, the annular valve member and valve seat being coaxial with the axis of symmetry, and the operating means moving the valve member axially in relation to the valve seat to assume a selected one of the positions.

5. In the combination of claim 4, the mounting being a housing having a top end in the outlet opening and carrying the universal joint, and a bottom end defining a discharge opening, and an outlet chute attached to the outlet end of the mixing receptacle and coaxially surrounding the outlet opening and the housing, the ring valve operating means being mounted in the chute for operation from the outside thereof, and any conveyed mixed material passing through the universal joint into the housing being received through the discharge opening in the outlet chute.

* * * * *